US008960199B2

(12) United States Patent
Zhuang et al.

(10) Patent No.: US 8,960,199 B2
(45) **Date of Patent: *Feb. 24, 2015**

(54) SMOKING ARTICLE WITH TOBACCO BEADS

(75) Inventors: Shuzhong Zhuang, Richmond, VA (US); Georgios D. Karles, Richmond, VA (US); Jose Nepomuceno, Beaverdam, VA (US); Richard Jupe, Richmond, VA (US); Gerson Assmann, Glen Allen, VA (US); Stephen Zimmermann, Midlothian, VA (US); Benjamin Lewis, Richmond, VA (US); James Sherron, Midlothian, VA (US); Vivian E. Willis, Maidens, VA (US)

(73) Assignee: Philip Morris USA Inc., Richmond, VA (US)

( * ) Notice: Subject to any disclaimer, the term of this patent is extended or adjusted under 35 U.S.C. 154(b) by 92 days.

This patent is subject to a terminal disclaimer.

(21) Appl. No.: 13/042,024

(22) Filed: Mar. 7, 2011

(65) Prior Publication Data

US 2011/0155154 A1 Jun. 30, 2011

Related U.S. Application Data

(63) Continuation of application No. 11/358,027, filed on Feb. 22, 2006, now abandoned.

(60) Provisional application No. 60/655,431, filed on Feb. 24, 2005.

(51) Int. Cl.
*A24B 1/00* (2006.01)
*A24D 3/14* (2006.01)

(Continued)

(52) U.S. Cl.
CPC . *A24B 15/14* (2013.01); *A24D 3/14* (2013.01); *A24D 3/048* (2013.01); *A24D 3/163* (2013.01); *A24D 3/06* (2013.01)
USPC ..... 131/360; 131/375; 131/369; 131/194; 131/331; 131/342; 424/751

(58) Field of Classification Search
None
See application file for complete search history.

(56) References Cited

U.S. PATENT DOCUMENTS 3,353,543 A 11/1967 Sproull et al.
4,355,995 A 10/1982 Berger (Continued)

FOREIGN PATENT DOCUMENTS

EP 0 352 107 A2 1/1990

OTHER PUBLICATIONS

International Preliminary Report on Patentability dated Aug. 28, 2007 for PCT/IB2006/001114.

(Continued)

*Primary Examiner* — Richard Crispino
*Assistant Examiner* — Phu Nguyen
(74) *Attorney, Agent, or Firm* — Buchanan Ingersoll & Rooney PC

(57) ABSTRACT

A component of a smoking article having tobacco beads. The tobacco beads can be located in a filter and/or a tobacco rod. The filter can be a multi-component filter, wherein an sorbent (preferably upstream) removes at least one constituent from mainstream tobacco smoke passing through the filter and downstream tobacco beads compensates for taste lost to the sorbent. The tobacco beads optionally include flavorants in addition to tobacco particulates. The tobacco beads can be located within a cavity in the filter or within the tow. This component can comprise additional flavors, which are released into the mainstream smoke under ambient conditions. The tobacco beads optionally include binders such as microcrystalline cellulose or other cellulosic material, which can be formed into a paste with tobacco powder and optionally with additional flavors. The paste can be extruded and spheronized to form the tobacco beads.

10 Claims, 3 Drawing Sheets

(51) Int. Cl.

| | |
|---|---|
| ***A24B 15/14*** | (2006.01) |
| ***A24D 3/04*** | (2006.01) |
| ***A24D 3/16*** | (2006.01) |
| ***A24D 3/06*** | (2006.01) |

(56) References Cited

U.S. PATENT DOCUMENTS

| | | | | | |
|---|---|---|---|---|---|
| 4,357,950 | A | | 11/1982 | Berger | |
| 4,893,639 | A | * | 1/1990 | White | 131/369 |
| 4,924,887 | A | * | 5/1990 | Raker et al. | 131/331 |
| 4,966,171 | A | | 10/1990 | Serrano et al. | |
| 5,263,999 | A | | 11/1993 | Baldwin et al. | |
| 5,725,886 | A | | 3/1998 | Erkoboni et al. | |
| 5,845,648 | A | | 12/1998 | Martin | |
| 5,997,691 | A | | 12/1999 | Gautam et al. | |
| 6,026,820 | A | | 2/2000 | Baggett, Jr. et al. | |
| 2002/0166563 | A1 | * | 11/2002 | Jupe et al. | 131/331 |
| 2005/0172976 | A1 | * | 8/2005 | Newman et al. | 131/194 |
| 2005/0244521 | A1 | | 11/2005 | Strickland et al. | |
| 2006/0272662 | A1 | | 12/2006 | Jupe et al. | |
| 2007/0084476 | A1 | | 4/2007 | Yang et al. | |

OTHER PUBLICATIONS

Chris Vervaet et al., Extrusion-Spheronisation a Literature Review, International Journal of Pharmaceutics, 116 (1995), pp. 131-146.

John C. Leffingwell et al., Tobacco Flavoring for Smoking Products, R. J. Reynolds Tobacco Company, 1972, cover page and table of contents.

F. El Saleh et al., Influence of Cellulose Type on the Properties of Extruded Pellets, S.T.P. Pharma Sciences 10, (5), 2000, pp. 379-385.

Otilia May Yue Koo et al., The Influence of Microcrystalline Cellulose Grade on Shape and Shape Distributions of Pellets Produced by Extrusion-Spheronization, Chem. Pharm. Bull. 49 (11) 2001, pp. 1383-1387.

Petra M. Fecher et al., Properties of Microcrystalline Cellulose and Powder Cellulose After Extrusion/Spheronization as Studied by Fourier Transform Raman Spectroscopy and Environmental Scanning Electron Microscopy, AAPS PharmSci. 2003; 5 (4), Article 31, pp. 1-13.

* cited by examiner

SMOKING ARTICLE WITH TOBACCO BEADS

CROSS REFERENCE TO RELATED APPLICATIONS

This application is a continuation application of U.S. patent application Ser. No. 11/358,027, entitled SMOKING ARTICLE WITH TOBACCO BEADS, filed Feb. 22, 2006 (abandoned), which claims priority under 35 U.S.C. 119(e) to U.S. Provisional Application No. 60/655,431, filed Feb. 24, 2005, the entire content of each is hereby incorporated herein by reference.

SUMMARY

In accordance with one embodiment, a smoking article such as a cigarette comprises a tobacco rod and a multi-component filter comprising a sorbent and secondly, tobacco beads. The tobacco beads comprise tobacco particulates and preferably consist essentially of tobacco particles, water and optionally one or more flavorants but without additional binder ingredient. The tobacco beads can further comprise a dry binder, a liquid binder, flavorants, controlled release coatings, and combinations thereof. The tobacco beads are preferably located downstream of the sorbent, but can be upstream of the sorbent as well. The tobacco bead (tobacco particles in a rounded, spheroid, or sphere shape which hereinafter are collectively referenced as a bead) is a flavor-releasing component located in the filter segment. However, the beads can also be located in the tobacco rod.

For tobacco beads which include a binder additive, preferably, about 10 weight % to about 90 weight % of the tobacco bead is tobacco particles, and more preferably from about 30 weight % to about 60 weight % of the tobacco bead is tobacco particles.

For tobacco beads which do not include a binder additive, preferably about 50 to 100% of the tobacco beads is tobacco particles, more preferably 90 to 100% of the tobacco beads is tobacco particles.

In another aspect, the smoking article contains about 20 mg to about 300 mg of tobacco beads. The tobacco particles in the tobacco beads can be tobacco dust, tobacco fines, or tobacco powder of a single tobacco variety or blends of tobaccos.

In an embodiment, the sorbent is also flavor-bearing and comprises high surface area, activated carbon. As mainstream smoke is drawn through the upstream portion of the filter, gas phase smoke constituents are removed, and flavor is released from the sorbent. Thereafter, additional flavor is released into the mainstream smoke as it passes through the flavor-releasing filter segment that includes beads comprising tobacco particles. The beads optionally further comprise a cellulosic material. The beads can further contain flavorants, additional dry and liquid binders and other fillers. Ventilation is provided to limit the amount of tobacco being combusted during each puff and is arranged at a location spaced downstream from the cellulose containing sorbent to lower mainstream smoke velocity through the sorbent. Preferably, the sorbent comprises an activated carbon bed of at least about 45 to about 180 mg or greater of activated carbon in a fully filled condition or about 90 mg to about 240 mg or greater of activated carbon in about an 85% filled condition or better, which in combination with other features, provides a flavorful cigarette that achieves significant reductions in gas phase constituents of the mainstream smoke, including 80 or 90% reductions or greater in 1,3-butadiene; acrolein; isoprene; propionaldehyde; acrylonitrile; benzene; toluene and/or styrene; and/or 80% reductions or greater in acetaldehyde and/or hydrogen cyanide. In another alternative of the ranges discussed above, the sorbent comprises an activated carbon bed of at least about 45 to about 180 mg or greater of activated carbon in a fully filled condition or about 90 mg to about 240 mg or greater of activated carbon in about an 85% filled condition or better, which in combination with other features, can provide a flavorful cigarette that achieves significant reductions in gas phase constituents of the mainstream smoke, including 80 or 90% reductions in 1,3-butadiene; acrolein; isoprene; propionaldehyde; acrylonitrile; benzene; toluene and/or styrene; and/or 80% reductions in acetaldehyde and/or hydrogen cyanide.

Advantageously, the filter addresses the desirability of achieving optimum residence times for the smoke in the regions of the filter bearing the sorbent material, while also achieving favorable dilution of the smoke with ambient air and inducing an acceptable resistance to draw as is expected by most smokers.

In a preferred embodiment, a cigarette filter is provided that includes tobacco beads constructed from tobacco particles or tobacco particles and cellulosic binder material, wherein the cellulosic material is preferably microcrystalline cellulose. The tobacco beads optionally may include flavorants.

For tobacco beads which include a binder additive such as microcrystalline cellulose (MCC), the MCC can be derived from bacterial, yeast, or plant sources and of any commercial or pharmaceutical source. Other cellulosic material is also contemplated for use in the beads as discussed herein. Combination of MCC grades and of different cellulosic materials are also contemplated in the formation of tobacco beads.

The tobacco beads can be located in a cavity within a filter or in a filter tow (beads-in-tow). The tobacco beads can release desired flavorant additives into mainstream smoke passing through the filter. The filters can be used in cigarettes with or without upstream sorbent material and in traditional or non-traditional cigarettes such as cigarettes smoked in electrically heated cigarette smoking systems or smoking articles which use heat from a combustible fuel element to volatilize tobacco.

Another aspect contemplates the use of the tobacco beads in the tobacco rod. A further aspect contemplates the beads being both upstream and downstream of a sorbent. Alternatively, no sorbent may be present in the smoking article comprising these beads.

Figure 1:
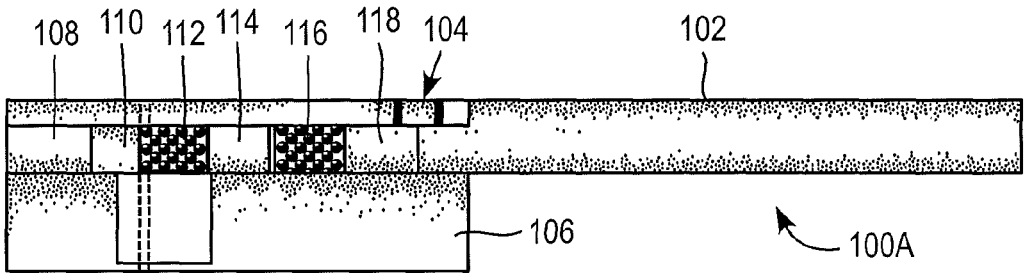
FIGS. 1-2 are side views of cigarettes having filters with upstream sorbent granules and downstream tobacco beads.

The drawings are exemplary only, and should not be construed as limiting the various embodiments set forth herein. For example, other filter designs such as coaxial segmented filters are also contemplated.

DETAILED DESCRIPTION

Herein, the "upstream" and "downstream" relative positions between filter segments and other features are described in relation to the direction of mainstream smoke as it is drawn from a tobacco rod and through a multi-component filter during a puff.

The filter comprises a first, upstream sorbent-bearing segment and a mouth end (mouthpiece) component. In this embodiment, the sorbent-bearing segment comprises a plug-space-plug filter sub-assembly that includes a central filter component, a tobacco end component in spaced apart relation to the central filter component so as to define a cavity therebetween, and a bed of high surface area, activated carbon material disposed in the cavity. The tobacco end component is located adjacent the tobacco rod and preferably, comprises a plug of cellulose acetate tow of low resistance to draw ("RTD"). Preferably, the tobacco end component is made as short as possible within the limits of high-speed machineability and preferably has the lowest particulate RTD amongst the filter components comprising the multi-component filter.

The mouth end (buccal) component is preferably in the form of a cellulose acetate plug or other suitable fibrous or webbed material of moderate to low particulate efficiency. Preferably, the particulate efficiency is low, with the denier and grand total denier being selected such that the desired total RTD of the multi-component filter is achieved.

Preferably, the activated carbon of the sorbent bed is in the form of granules and the like. Preferably, the activated carbon of the embodiment is a high surface area, activated carbon, for example a coconut shell based activated carbon of typical ASTM mesh size used in the cigarette industry or finer. The bed of activated carbon is adapted to adsorb constituents of mainstream smoke, particularly, those of the gas phase including aldehydes, ketones and other volatile organic compounds, and in particular 1,3-butadiene; acrolein; isoprene; propionaldehyde; acrylonitrile; benzene; toluene; styrene; acetaldehyde; and hydrogen cyanide. Sorbent materials other than activated carbon may be used as explained below and fall within the definition of sorbent materials as used herein.

With respect to the activated carbon particles, it is preferred that they have a mesh size of from 10 to 70 or 80, and more preferably a mesh size of 20 to 50 or 60.

Optionally, at least some, if not all, of the sorbent bed is flavor-bearing or otherwise impregnated with a flavor so that the sorbent bed of the upstream sorbent bearing segment is adapted not only to remove one or more gas phase smoke constituents from mainstream smoke, but also to release flavor into the mainstream smoke stream. Preferably, flavor is added to the activated carbon by spraying flavorant upon a batch of activated carbon in a mixing (tumbling) drum or alternatively in a fluidized bed with nitrogen as the fluidizing agent, wherein flavorant may then be sprayed onto the activated carbon in the bed. However, the sorbent bed can alternatively be not flavored.

Preferably, one or more circumferential rows of perforations are formed through the tipping paper at a location along the central component and downstream of the bed of flavored activated carbon, preferably at the upstream end portion of the central component adjacent the activated carbon bed. The placement maximizes distance between the buccal end of the cigarette and the perforations, which preferably is at least 12 mm (millimeters) or more, so that a smoker's lips do not occlude the perforations. Furthermore, because the introduction of diluting air flows at an upstream end portion of the central segment, itself, lowers the particulate efficiency of the downstream portions of the segment, the upstream location of the ventilation along the filter component facilitates design of the component to provide a more elevated (yet moderate) RTD without a significant elevation of particulate efficiency, so as to help maintain a desired low particulate efficiency in the central component and throughout the filter.

The level of ventilation is preferably in the range of about 40 to about 60%, and more preferably approximately from about 45 to about 55% in a 6 mg FTC tar delivery cigarette.

It is believed that ventilation not only provides dilution of the mainstream smoke but also effects a reduction of the amount of tobacco combusted during each puff when coupled with a low particulate efficiency filter. Ventilation reduces drawing action on the coal and thereby reduces the amount of tobacco that is combusted during a puff. As a result, absolute quantities of smoke constituents are reduced. Preferably, the various filter components (the central filter segment, the tobacco end filter segment, the activated carbon bed and mouth end component) are provided low particulate efficiencies, and the amount of ventilation is selected such that differences between the desired FTC tar delivery of the cigarette and the output the tobacco rod are minimized. Such arrangement improves the ratio of carbon monoxide ("CO") content of the delivered smoke to its FTC tar level (CO to Tar ratio). In contrast, prior practices tended to first establish an output level of the tobacco rod and utilized particulate filtration to drive FTC tar delivery down to a desired level. These prior practices tended to combust an excess of tobacco, and accordingly, exhibit higher CO to Tar ratios than typically achieved with preferred cigarette embodiments disclosed herein.

The perforations are located downstream from the activated carbon bed so that mainstream smoke velocity through the activated carbon bed is reduced and dwell time of the main stream smoke amongst the activated carbon bed is increased. The extra dwell time, in turn, increases the effectiveness of the activated carbon in reducing targeted mainstream smoke constituents. The smoke is diluted by ambient air passing through perforations and mixing with the mainstream smoke to achieve air dilution in the approximate range of 45-65%. For example, with 50% air dilution, the flow through the cigarette upstream of the dilution perforations is reduced 50%, thereby reducing the smoke velocity by 50%.

Preferably, the activated carbon bed comprises at least 45 to 180 mg (milligrams) or greater of activated carbon in a fully filled condition, or 90 to 240 mg or greater of activated carbon in an 85% filled condition or better in the cavity, which in combination with the extra dwell time and flavor release as described above, provides a flavorful cigarette that achieves significant reductions in gas phase constituents of the mainstream smoke, including reductions in 1,3-butadiene; acrolein; isoprene; propionaldehyde; acrylonitrile; benzene; toluene; styrene; and reductions of acetaldehyde and hydrogen cyanide. The elevated activated carbon loading also assures an adequate activity level sufficient to achieve such reductions throughout the expected shelf-life of the product (six months or less).

By way of example, the length of tobacco rod is preferably 49 mm, and the length of the multi-component filter is preferably 34 mm. The length of the four filter components of cigarette in an embodiment is as follows: the tobacco end component is preferably 6 mm; the length of the activated carbon bed is preferably 12 mm for activated carbon loading of 180 mg; the central component is preferably 8 mm; and mouth end component is preferably 8 mm. Overall, the level of "tar" (FTC) is preferably in the range of 6 mg with a puff count of 7 or greater. All of the components are of low particulate efficiency, and preferably, amongst all the fibrous or web segments, the tobacco end component is of lowest RTD and particulate efficiency, because it is upstream of the ventilation and therefore has greater effect upon the mainstream smoke. Unlike those other fibrous or webbed components, the tobacco end component receives the mainstream smoke in the absence of a diluting air stream.

The tobacco rod may be wrapped with a conventional cigarette wrapper or banded paper may be used for this purpose. Banded cigarette paper has spaced apart integrated cellulose bands that encircle the finished tobacco rod of cigarette to modify the mass burn rate of the cigarette so as to reduce risk of igniting a substrate if the cigarette is left thereon smoldering. U.S. Pat. Nos. 5,263,999 and 5,997,691 describe banded cigarette paper, which patents are incorporated herein in their entirety for all purposes.

In an embodiment, the particulate efficiency for the entire filter is preferably in the range of approximately 40 to 45%, as measured under USA/FTC smoking conditions (35 cubic centimeter puff over two seconds).

In an embodiment, it is preferable to load approximately 180 mg of activated carbon plus or minus approximately 10 mg of activated carbon to achieve an average 85% fill in a 12 mm cavity at the more traditional cigarette circumferences (approximately 22 to 26 mm). This level of fill together with that amount of activated carbon will achieve 80 or 90% tar weighted reduction of acrolein and 1,3-butadiene relative to an industry standard, machine made cigarette (known as a 1R4F cigarette).

Lower activated carbon loadings can be utilized to equal effect as one approaches a fully filled condition of 95% or greater. With activated carbon loadings in the range of 45 to 180 mg, fully filled plug-space-plug filters provide 80 or 90% or greater reduction in acrolein and 1,3-butadiene in relation to levels of such in 1R4F cigarettes. Such arrangement provides significant savings in amounts of activated carbon that may be needed to remove these smoke constituents, and offers substantial savings in costs of manufacture. The compressed and/or fully filled plug-space-plug filter configuration also provides a more consistent performance in gas phase treatment from cigarette to cigarette.

If desired, an RTD filter plug can be used in place of the second cellulose tow. Filter plug is positioned between the activated carbon material and flavor-releasing component, and the plug may comprise an impervious hollow plastic tube closed by crimping at the upstream end thereof. U.S. Pat. No. 4,357,950, describes such a plug, which patent is hereby incorporated herein by reference, in its entirety for all purposes. In the alternative, such filter components may be obtained from the aforementioned American Filtrona Company of Richmond, Va. As a result of filter plug, a transition region is provided from a generally circular cross-sectional region of activated carbon material having a low pressure drop to a generally annular cross-sectional region having a high pressure drop. This transition region and the downstream location of perforations results in high retention or residence times for the mainstream smoke upstream of the perforations. As a result, favorable reduction in gas phase constituents is achieved per puff of cigarette, along with favorable dilution by ambient air and acceptable drawing characteristics. Flavor is released to the diluted mainstream smoke as it passes through the flavor-releasing component.

The filter plug may also include a low efficiency cellulose acetate tow on the outside thereof. The transition from the generally circular cross-section to the generally annular cross-section, and the downstream location of the air dilution perforations increases the pressure drop and increases the retention time of the smoke in contact with the activated carbon in the filter plug. The smoke is diluted by air passing through perforations and mixing with the smoke to achieve air dilution in the approximate range of 45-65%. For example, with 50% air dilution, the flow through the cigarette upstream of the dilution perforations is reduced 50%, thereby reducing the smoke velocity by 50%, which basically increases the dwell time in the filter plug by a factor of two. This embodiment of the multi-component filter positions the maximum amount of activated carbon material upstream of the air dilution perforations.

While a crimped plastic tube can be used for affecting a transition from a high retention time region to a high pressure drop region, it is contemplated that other shapes, such as conical or blunt ends can be used. In addition, a solid member, such as one made of high density (and hence impervious) cellulose acetate tow or a solid rod can also be used. Other impervious membrane structures are also contemplated.

If desired, a concentric core filter plug can be used in place of the "COD" or carbon monoxide dilution filter plug described above. The concentric core filter plug is positioned between the activated carbon material and flavor releasing component, and the plug may comprise a highly impervious solid cylindrical rod surrounded by a low efficiency cellulose acetate tow on the outside thereof. As a result of the concentric core filter plug a sharp transition region is provided from a generally circular cross-sectional region of activated carbon material having a low pressure drop to a generally annular cross-section region having a high pressure drop. This transition and the downstream location of perforations results in high retention or residence times for the mainstream smoke upstream of the perforations.

Alternatively, the concentric filter plug may be constructed so that the flow therethrough is essentially through the core with limited flow through the annular space outside the core.

One or more rows of perforations at or about the plug can be used to provide both dilution of the mainstream smoke by ambient air and a reduction of the amount of tobacco combusted during each puff. Ventilation reduces production and delivery of particulate (tar) and gas phase (CO) constituents during a puff.

While various embodiments have been described above, it is recognized that variations and changes may be made thereto. For instance, the plug-space-plug segment or the activated carbon bed might be replaced with an agglomerated activated carbon element or other form of sorbent that is adapted to remove gas phase constituents from mainstream smoke. In this regard, the activated carbon bed may also comprise a combination of activated carbon and fibers. Also, the plug components might be constructed of filter materials other than those specifically mentioned herein. The ventilation might be constructed using known on-line or off-line techniques.

The flavor releasing component is in the form of tobacco beads or tobacco beads in tow. Preferably, the tobacco beads consist essentially of tobacco particles, water and optional flavorants but without added binder ingredients. In the alternative, the tobacco beads may further contain an added binder ingredient, wherein the binder is preferably a cellulosic material. A preferred cellulosic material is microcrystalline cellulose. Additional dry and liquid binders may be present in the beads as well as additional flavorants and fillers. If desired, the tobacco beads can include one or more coatings. Flavorants can also be added to the tobacco beads and/or to the coatings of the beads. However, the tobacco beads preferably are beads comprising tobacco particles and water that are held together without addition of a binder additive other than water.

The tobacco beads are preferably located in a portion of the filter downstream of a sorbent material (such as activated carbon) so that flavor released from the tobacco beads does not pass through the sorbent. Thus, deactivation of the sorbent by released flavors from the tobacco beads can be substantially avoided; and delivery of flavor can be enhanced since the released flavor does not travel through the sorbent during smoking. Not wishing to be bound by theory, at the downstream location of the tobacco beads, which may possess additional flavor, the temperature of tobacco smoke passing through the filter is in a cooled condition, essentially at or about room temperature. Despite the absence of heat from the cigarette coal (or any addition of moisture), it has been found that the tobacco beads are effective in releasing flavor into the mainstream smoke so as to produce a flavored smoke. The flavors released from the tobacco beads are flavors specific to the tobacco source and/or flavors added to the beads during their production. The organoleptic notes from using tobacco beads are associated with enhanced tobacco character and reduced "carbon" taste. Preferably, the flavors from the tobacco particulates and/or flavor components are released into the mainstream tobacco smoke under essentially ambient conditions.

FIGS. 1-5 show layouts of filter arrangements incorporating tobacco beads downstream of a sorbent preferably in the form of beaded and/or particulate activated carbon. Although certain dimensions are disclosed with reference to the embodiments shown, such dimensions can be varied to provide different amounts of sorbent or tobacco beads in the filters.

In FIG. 1, a cigarette 100A includes a tobacco rod 102, which is preferably 49 mm long, and a filter 104, which is preferably 34 mm long held together by tipping paper 106. The filter 104 includes segments of filter material and two cavities which contain tobacco beads, which may comprise additional flavorants, in one cavity and a sorbent preferably in the form of beaded and/or particulate activated carbon in another cavity. From the mouth end of the filter, preferably the segments include a 7 mm long cellulose acetate (CA) plug 108, a 5 mm long CA plug 110, a 6 mm long cavity 112 containing tobacco beads, a 5 mm long CA plug 114, a 6 mm long cavity 116 containing beaded activated carbon, and a 5 mm long CA plug 118. The filter can be manufactured by making and filling upstream and downstream plug-space-plug sections in sequence or simultaneously. For instance, a continuous rod can be manufactured with repeating segments corresponding to the CA plug 110, cavity 112 containing tobacco beads and CA plug 114 wrapped in paper, and the rod can be cut into 16 mm long sections, each section comprising segments 110, 112, and 114. The sections with segments 110, 112, and 114 can be formed into a second continuous rod, which includes the cavity 116 containing beaded and/or particulate activated carbon and the CA plug 118 wrapped in paper; and the rod can be cut into 27 mm long sections, each section comprising segments 110, 112, 114, 116, and 118. These sections can then be combined with CA plug 108 to form filters 104.

Figure 2:
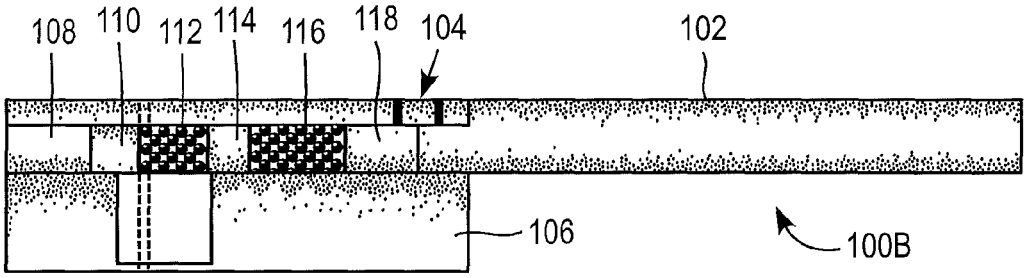

In FIG. 2, a cigarette 100B includes a tobacco rod 102, which is 49 mm long, and a filter 104, which is 34 mm long held together by tipping paper 106. The filter 104 includes segments of filter material wherein tobacco beads are in one cavity and beaded and/or particulate activated carbon in another cavity. From the mouth end of the filter, preferably the segments include a 7 mm long cellulose acetate (CA) plug 108, a 5 mm long CA plug 110, a 4 mm long cavity 112 containing tobacco beads, a 5 mm long CA plug 114, an 8 mm long cavity 116 containing beaded and/or particulate activated carbon, and a 5 mm long CA plug 118. The filter can be manufactured by making upstream and downstream plug-space-plug sections. For instance, a continuous rod can be manufactured with repeating segments corresponding to the CA plug 110, cavity 112 containing tobacco beads and CA plug 114 wrapped in paper; and the rod can be cut into 14 mm long sections, each section comprising segments 110, 112, and 114. The sections with segments 110, 112, and 114 can be formed into a second continuous rod which includes the cavity 116 containing beaded activated carbon and the CA plug 118 wrapped in paper and the rod can be cut into 27 mm long sections, each section comprising segments 110, 112, 114, 116, and 118. These sections can then be combined with a cellulose acetate (CA) plug 108 to form filters 104.

Figure 3:
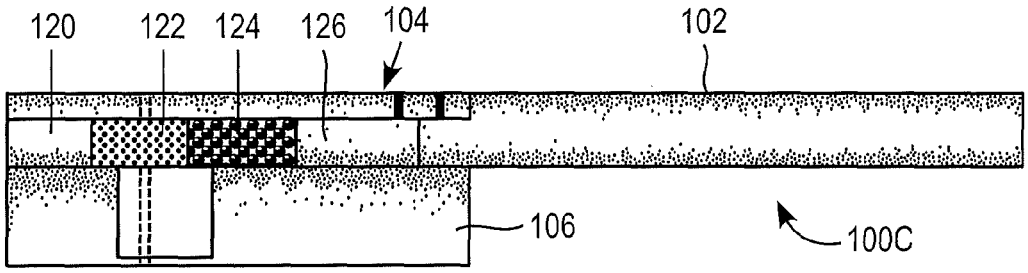
FIG. 3 is a side view of a cigarette having a filter with upstream sorbent granules and downstream plug of filter material containing tobacco beads.

In FIG. 3, a cigarette 100C includes a tobacco rod 102, which is 49 mm long, and a filter 104, which is 34 mm long held together by tipping paper 106. The filter 104 includes segments of filter material and one cavity containing granular material, i.e., beaded and/or particulate activated carbon in a cavity and tobacco beads in a plug of filter tow material. From the mouth end of the filter, the segments include an 8 mm long cellulose acetate (CA) plug 120, an 8 mm long CA plug 122 containing tobacco beads that are dispersed among the fibers of the plug 122, an 8 mm long cavity 124 containing beaded activated carbon, and a 10 mm long CA plug 126. The filter can be manufactured as a four-segment filter. For instance, a continuous rod can be manufactured with repeating segments corresponding to the CA plug 120, CA plug 122 containing tobacco beads, cavity 124 containing beaded and/or particulate activated carbon and CA plug 126 wrapped in paper, and the rod can be cut into 34 mm long sections, each section comprising segments 120, 122, 124, and 126.

Figure 4:
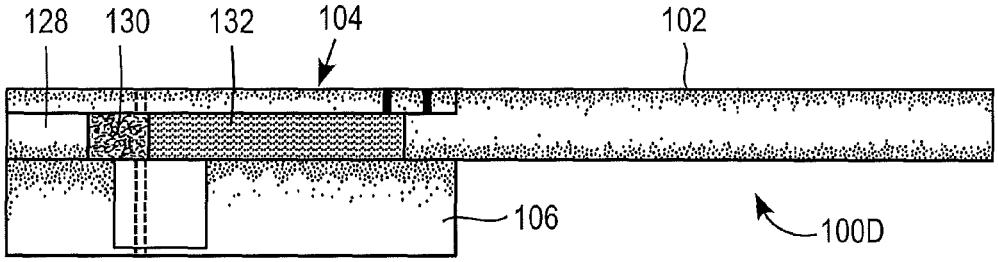
FIG. 4 is a side view of a cigarette having a filter with upstream sorbent granules and downstream tobacco beads in a plug of filter material.

In FIG. 4, a cigarette 100D includes a tobacco rod 102, which is 49 mm long, and a filter 104, which is 34 mm long held together by tipping paper 106. The filter 104 includes segments of filter material, tobacco beads in a cavity and activated carbon sorbent in a plug of filter tow material. From the mouth end of the filter, the segments include a cellulose acetate (CA) plug 128, a cavity 130 containing tobacco beads, and a CA plug 132 having activated carbon sorbent incorporated (distributed) therein. The filter can be manufactured as a three segment filter. For instance, a continuous rod can be manufactured with repeating segments corresponding to the CA plug 128, cavity 130 containing tobacco beads and CA plug 132 containing activated carbon sorbent wrapped in paper and the rod can be cut into sections, each section comprising segments 128, 130 and 132.

Figure 5:
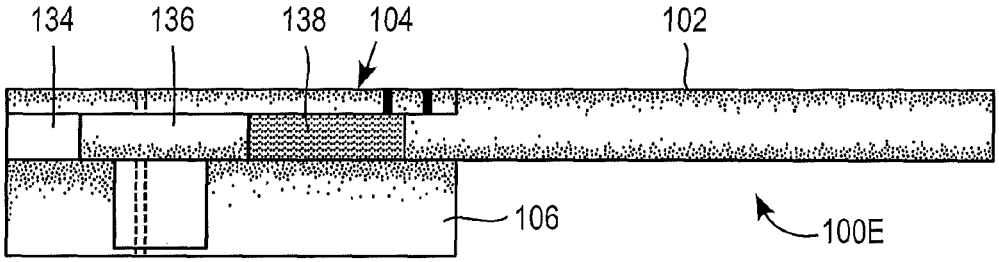
FIG. 5 is a side view of a cigarette having a filter with upstream sorbent in a plug of filter tow material and downstream tobacco beads in a plug of filter tow material.

In FIG. 5, a cigarette 100E includes a tobacco rod 102, which is 49 mm long, and a filter 104, which is 34 mm long held together by tipping paper 106. The filter 104, includes three segments of filter material, wherein the activated carbon sorbent and tobacco beads are contained in plugs of filter tow material (activated carbon-on-tow and tobacco beads-on-tow). From the mouth end of the filter, the segments include a cellulose acetate (CA) plug 134, a CA plug 136 containing tobacco beads, and a CA plug 138 containing activated carbon sorbent. The filter can be manufactured as a three segment filter.

Figure 6:
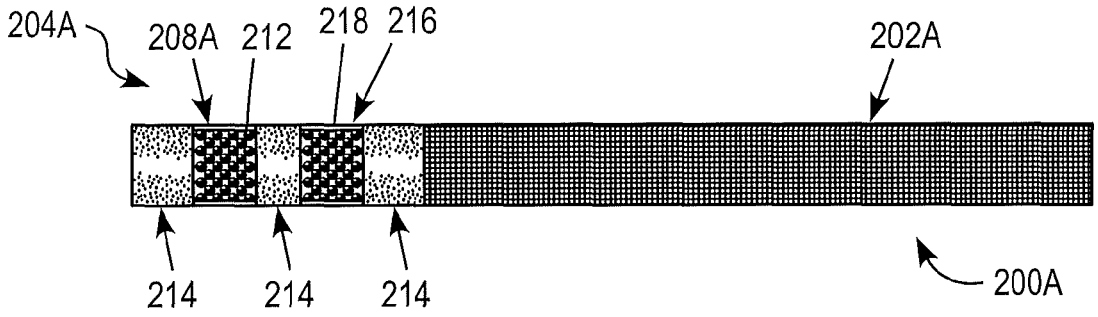
FIG. 6 is a side view of a cigarette having a filter, which comprises tobacco beads downstream (toward the buccal end of the cigarette) from an adsorbent.

In FIG. 6, a cigarette 200A includes a tobacco rod 202A and a filter 204A, which are held together by tipping paper. The filter 204A includes segments of filter material and two cavities. The cavity located on the buccal end of the cigarette 208A contains tobacco beads 212. Thus, from the buccal end of the cigarette, the segments include a cellulose acetate (CA) plug 214, a downstream cavity 208A, a second cellulose acetate plug 214, an upstream cavity 216, and a third cellulose acetate plug 214 forming a plug-space-plug configuration. The taste of the cigarette smoke, in which a portion of the gas-phase constituents have been removed by the sorbents 218 within the cavity 216 is enhanced due to the presence of the tobacco beads 212 located toward the buccal end of the cigarette 200A.

Figure 7:
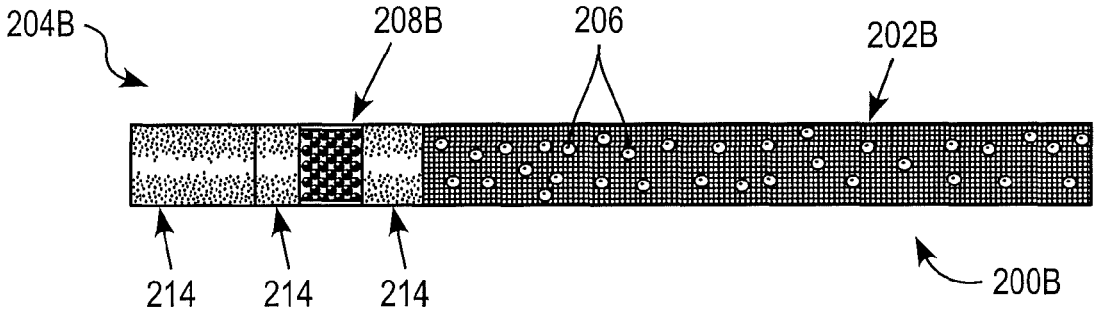
FIG. 7 is a side view of a cigarette having a tobacco rod, which has tobacco beads distributed along the tobacco rod.

In FIG. 7, another preferred embodiment is depicted. A cigarette 200B is formed with a tobacco rod 202B attached to a filter region 204B using for example tipping paper, wherein tobacco beads 206 are in the tobacco rod 202B. The tobacco beads 206 can contain volatile liquids, such as aerosol forming agents, and/or flavors. The tobacco beads 206 are then incorporated in the tobacco filler of the tobacco rod 202B of the cigarette 200B. For example, the volatile liquids are trapped inside the matrix of tobacco beads, such that their evaporation and migration during storage of cigarette 200B is minimized. Coatings can be used on the tobacco beads to reduce migration potential and/or provide controlled release of the components of the beads. Additionally, the filters can comprise both coated and uncoated tobacco beads. During a smoking, the volatile compounds are released by heat, enhancing the taste of the smoke and the composition of the tar in the smoke. The smoke is then drawn through, for example, 2 to 3 CA filters 214 and an sorbent region 208B located between the CA filters.

The tobacco beads are preformed. Flavorants can be included during the process of making the tobacco beads or can be later added to the beads. Alternatively or in addition, flavorants can be added to a coating on the beads, said coating having perhaps the additional function of providing a controlled release of the components in the beads. Volatile flavorants can be added during the process of preparing the beads or to the preformed beads, depending on the process used for preparing the beads. Depending on the method of preparing the beads, it may be more preferable to add volatile flavorants to the preformed beads rather than during the process of preparing the beads. Liquid compounds can be added to the beads by for example impregnating the beads with liquid formulations containing for example volatile flavors, diluents, and the like. Alternatively, compounds and compositions can be added to the beads by mixing the beads or by fluidized bed spraying of the beads or by other suitable methods.

The functionality of the tobacco beads can be tailored to have more of controlled-delivery release of active compounds. For example, diffusion of the flavors from the beads can be adjusted by bead porosity and density as well as by any controlled-release coating added to the beads. For instance, the beads can be overcoated with polymeric coatings of different functionalities and or compositions (e.g., single or multiple overcoats depending on the application) to control the delivery and release of the active compounds.

In another aspect, the tobacco beads can act as a delivery system for delivering flavors naturally occurring in the components of the bead formulation. Alternatively, the tobacco beads can act as a medium for creating and/or enhancing naturally occurring flavors through Mallard, enzymatic, or other types of reactions. It is further contemplated that the beads can be altered or enhanced by thermal treatment of the beads after formation. The thermal treatment can further enhance reactions such as Mailard reactions and enzymatic reactions and thereby flavors of the smoking article containing said beads. For example, the beads can be treated by heating at a temperature from about 40° C. to about 300° C. for a period of about 5 minutes to several hours.

The tobacco beads can be prepared using known extrusion and spheronization processes or high shear granulation for producing pharmaceutical pellets and flavored beads.

For tobacco beads consisting essentially of tobacco particles, water and optional flavorants but not including added binder ingredients, one method of making the beads comprises (1) mixing tobacco particles with water to form a uniform wet mass and optionally flavorants; (2) forcing the uniform wet mass through a restricted area via extrusion to form strands of extrudate; (3) breaking the extrudate strands into short lengths and rounding the broken extrudate pieces by placing them on a rotating plate within a cylinder to form wet spheres; and (4) drying the wet spheres to remove a portion of the liquid. Additionally flavorants and/or coatings can be added after drying and/or the beads can further undergo a thermal treatment as discussed above.

For tobacco beads containing added binder ingredients, the mixing step will include mixing the tobacco particles with a dry and/or liquid binder. For example, the tobacco particles can then be mixed with a suitable dry binder, such as those disclosed herein or for example an extrusion and spheronization aiding composition and reagents, a water swellable polymer, polymer binders or mixtures of these reagents. The admixed binder-tobacco particles composition can then be further admixed with a liquid binder to form a uniform wet mass. Alternatively, the admixed binder-tobacco particles comprising composition can be further admixed with flavorants and/or flavor precursors, or any combination of liquid and dry binders, flavorants, flavor precursors, and fillers.

The materials of extrusion and spheronization aiding reagents are those which are capable of holding liquid rather like a sponge. These reagents also further restrict the separation of the liquid from the solid that can occur during extrusion and spheronization processes. The extrusion and spheronization aiding reagents include but are not limited to microcrystalline cellulose (MCC), pectinic acid, lactose, and glyceryl monostearate, and combinations thereof. The water-swellable polymers can be, but are not limited to, hydroxypropyl methylcellulose (HPMC), low substituted hydroxypropyl cellulose (L-HPC), and hydroxypropyl cellulose (HPC). The polymer binders can be, but are not limited to polyvinyl pyrolidone (PVP), EUDRAGIT®, and cellulose ethers.

The tobacco beads can optionally include an aerosol forming agent, such as glycerin, propylene glycol, triacetin, propylene carbonate, and combinations thereof.

The tobacco particles can be formed by taking parts of the tobacco plant (leaf, stem, and the like) and grinding the dried portions into a fine powder or dust. The tobacco parts used to make the tobacco particles can be from any different type of tobacco used to prepare smoking articles such as but not limited to Burley, Bright, Oriental, or blends thereof, as well as genetically altered, chemically altered, or mechanically altered tobacco plants and blends thereof.

The blend of the tobacco particles used, the formulation of the optional dry or liquid binder, the concentration of liquid in the tobacco beads, and the size of the tobacco beads are all elements which can be altered alone or in combination with each other to achieve a desired taste for the cigarette smoke. It is further noted that the quantity and the blend of the optional powdered binder used can be selected so as to achieve the desired mechanical strength and roundness of the resulting tobacco beads. The strength and roundness of the beads depends in part on the starting materials. For example, the tobacco beads can optionally comprise a cellulosic binder material as well as the tobacco particles.

The tobacco beads formed using the methods discussed provide multiparticulates of tobacco in a spherical shape. The resulting tobacco beads possess good flow properties in filter rod making machines, low friability, and uniform packing characteristics. As a flavor carrier, these tobacco beads provide additional tobacco related aroma to the smoke of the smoking article, as compared to the flavor carriers made from non-tobacco materials.

The volatile liquid compounds, such as flavor compounds and aerosol agents, are trapped in the matrix of the tobacco beads. The shelf life of the liquid component(s) in the matrix is extended. The migration of the volatile component(s) to the sorbents in the smoking article is minimized, thereby permitting the sorbents to adsorb other components. Finally, it is preferred that the release of the flavors and/or aerosol agents from the matrix of the tobacco beads during smoking can be controlled.

Another embodiment contemplates that the tobacco beads, which naturally have the flavors from the tobacco resident in the beads can be further enhanced by adding additives during the bead making process. This can include additives such as flavors as well as components which would enhance the formation of flavors by reactions such as Mailard reactions between the components to naturally enhance the smoke.

A method for forming tobacco beads consisting essentially of tobacco particles, water and optional flavorants but not including added binder ingredients comprises: (a) mixing a blend of ground tobacco particles and water to form a mixture; (b) extruding the mixture to form an extrudate; (c) rounding the extrudate into a beaded form, wherein the tobacco beads have a first moisture content; and (d) drying the tobacco beads to a second moisture content.

The tobacco beads can comprise tobacco particles with only water and optional flavorants or the tobacco beads can further include binder additive materials other than water. The moisture content in the tobacco beads includes moisture from the starting ground tobacco particles and added water. Such water content can be determined by heating the tobacco beads at 220° F. for five minutes and measuring the weight loss.

In the method for forming the tobacco beads consisting essentially of tobacco particles, water and optional flavorants but not including added binder ingredients, the ratio of the amount of the tobacco particles and water can be about 1:4 to about 4:1, preferably about 2:1. In an embodiment, the first moisture content is preferably about 20 to 40% of a total weight of the moist tobacco beads. The second moisture content of the tobacco beads, after drying, is about 8% to about 25% of a total weight of the tobacco beads. For example, the second moisture content can be about 8% to about 25%, e.g., about 8% to about 10%, about 10% to about 15%, about 15% to about 20%, or about 20% to about 25% of a total weight of the tobacco beads. The ground tobacco particles preferably have an average particle diameter suitable for forming a wet tobacco mixture which can be formed into tobacco beads. The tobacco beads are preferably in the form of spheroids, wherein the spheroids are substantially round or substantially oval in shape. Further, each spheroid of the tobacco beads can have a diameter of about 0.1 to about 2.5 mm, preferably about 0.2 to about 1.2 mm, and more preferably about 0.3 to about 0.7 mm. The ground tobacco is preferably sieved with mesh size 35 to provide tobacco particles with a maximum particle size of about 0.5 mm.

The blend of ground tobacco particles is preferably obtained from the lamina of tobacco plants. Tobacco beads which contain only tobacco lamina of Burley, Bright and/or Oriental and other tobacco varieties can provide delivery of enhanced flavor to mainstream smoke passing through the filter of a smoking article containing the tobacco beads. However, other tobacco plant parts such as ground stems and tobacco dust can be included in the ground tobacco particles. The type of tobacco is preferably selected from the group consisting of Burley, Bright, and Oriental. The blend of ground tobacco particles can include up to 5%, 10%, 15%, 20%, 25%, 30%, 35%, 40%, 45%, 50%, 55%, 60%, 65%, 70%, 75%, 80%, 85%, 90%, 95%, or 100% by weight of Burley; up to 5%, 10%, 15%, 20%, 25%, 30%, 35%, 40%, 45%, 50%, 55%, 60%, 65%, 70%, 75%, 80%, 85%, 90%, 95%, or 100% by weight of Bright; and/or up to 5%, 10%, 15%, 20%, 25%, 30%, 35%, 40%, 45%, 50%, 55%, 60%, 65%, 70%, 75%, 80%, 85%, 90%, 95%, or 100% by weight of Oriental.

The tobacco beads can be formed from the extrudate by using an LCI QJ-230T Marumerizer at a suitable rotation speed (e.g., 1200 RPM) for a suitable time (e.g., 10 minutes). The tobacco beads can further comprise optional flavorant. The optional flavorant includes flavor materials that are practically unlimited, although water-soluble, alcohol-soluble and oil-soluble flavors are preferable. Typical flavors include lavender, cinnamon, cardamom, apium graveolens, fenugreek, cascarilla, sandalwood, bergamot, geranium, honey essence, rose oil, vanilla, lemon oil, orange oil, mint oils, cassia, caraway, cognac, jasmine, chamomile, menthol, cassia, ylang-ylang, sage, spearmint, ginger, coriander, and coffee. Each of the flavors can be used singly or mixed with others. If desired, diluent agents can be added to the tobacco beads. Diluent agents which can be used for this purpose include powdered starch, such as but not limited to corn starch and potato starch, rice powder, calcium carbonate, diatomaceous earth, talc, acetate powder, and pulp flock. The optional flavorant can also be in the form of a solid matrix (liquid flavorants spray dried with a starch). The optional flavorant can also be in the form of solids, liquids or gels. The optional flavorant can be present in the tobacco beads in an amount of up to 50% by weight (e.g., 0.1 to 5%, 5 to 10%, 10 to 15%, 15 to 20%, 20 to 25%, 25 to 30%, 30 to 35%, 35 to 40%, 40 to 45% or 45 to 50%).

The drying of the tobacco beads consisting essentially of tobacco particles but without added binder ingredients can be carried out under vacuum to the second moisture content of about 8% to about 25% of a total weight of the tobacco beads. Preferably, the second moisture content is about 10 to 20%, and most preferably about 12% to about 18% of a total weight of the tobacco beads. As an alternative, the drying of the tobacco beads can be carried out in other drying equipment such as a conventional fluidized bed dryer or in a conventional oven dryer. However, vacuum drying of the tobacco beads is preferred because the taste resulting from the tobacco beads in a smoking article is enhanced when vacuum drying is used. Not wishing to be bound by theory, it is believed that vacuum drying minimizes loss of organic compounds providing desired organoleptic properties and promotes migration of flavor compounds to the surface of the tobacco beads. Accordingly, a preferred tobacco bead comprises a bead of tobacco particles in a condition of having been vacuum dried to a predetermined moisture content of about 8 to 25% by weight.

For tobacco particles containing additive binder such as a non-tobacco cellulosic material, microcrystalline cellulose (MCC) is the preferred cellulosic material in combination with tobacco particles. Whereas various flavor carriers may need heat or water to release volatile flavor compounds into mainstream smoke, cellulosic binder containing tobacco beads can release such flavor constituents under ambient conditions. While any conventional cigarette flavor additives such as tobacco extracts and menthol can be optionally incorporated in the tobacco beads, it is preferred that the cellulosic binder containing tobacco beads incorporate flavor additives, which compensate for loss of desired taste due to filtration by the upstream sorbent material. In the case of an upstream activated carbon sorbent, the tobacco beads preferably add to the filtered mainstream smoke flavor constituents, which meet the smoker's expectations for the type of cigarette being smoked, e.g., full flavor, mild flavor, or the like.

The optional flavor additives for the tobacco beads can be incorporated for example using a solvent mixture. A preferred solvent mixture does not impart undesired aftertastes to the mainstream smoke passing through the filter. Using a solvent mixture, it is possible to incorporate the optional flavor constituents into the cellulosic binder containing tobacco beads in minute amounts, on the order of parts per million.

In embodiments which include added binder ingredients, microcrystalline cellulose is a preferred cellulosic binder material. However, other materials which can be used include carboxymethyl cellulose (CMC), and more amorphous forms of cellulose (e.g., powdered cellulose) as well as combinations of crystalline, and modified cellulose (e.g., hydroxypropyl cellulose and hydroxypropyl methylcellulose), and amorphous cellulose. Other natural polysaccharides and their derivatives are also contemplated for use in the tobacco beads.

Flavor materials that optionally can be used within the tobacco beads with added binder are practically unlimited, although water-soluble, alcohol-soluble and oil-soluble flavors are preferable. Typical flavors include lavender, cinnamon, cardamom, apium graveolens, fenugreek, cascarilla, sandalwood, bergamot, geranium, honey essence, rose oil, vanilla, lemon oil, orange oil, mint oils, cassia, caraway, cognac, jasmine, chamomile, menthol, cassia, ylang-ylang, sage, spearmint, ginger, coriander, and coffee. Each of the flavors can be used singly or mixed with others. If desired, diluent agents can be added to the tobacco beads. Diluent agents which can be used for this purpose include powdered starch, such as but not limited to corn starch and potato starch, rice powder, calcium carbonate, diatomaceous earth, talc, acetate powder, and pulp flock. Flavorants can also be in the form of a solid matrix (liquid flavorants spray dried with a starch). Flavorants can also be in the form of solids, liquids or gels.

In accordance with an embodiment, the tobacco beads with added binder ingredients can be prepared by an extrusion and spheronization technique, wherein a wet mass of tobacco powder, binder additive and optional flavoring material is extruded, the extrudate is broken up, the resulting particles are rounded into spheres, and dried to produce tobacco beads. The wet mass can be prepared in a mixer such as a planetary mixer, wherein mixing occurs. The extrusion can be carried out using extruders such as the screw, sieve and basket, roll and ram type extruders. Spheronization can be carried out using a spinning friction plate that effects rounding of extrudate particles. Water is preferably used to provide the wet mass with desired rheological characteristics. For example, the water content can be adjusted to achieve the desired plasticity, e.g., the water content may range from 20% to 150% (preferably 40 to 60%) by weight or at least about in a proportion of one-to-four to four-to-one of liquid to dry material. With use of liquid flavorants, the liquid content of the wet mass is preferably adjusted to account for the effect of the liquid flavorant on the rheological characteristics of the wet mass. Details of extrusion and spheronization techniques can be found in "Extrusion-Spheronisation—A Literature Review" by Chris Vervaet et al., 1995 *International Journal of Pharmaceutics* 116: 131-146. See also U.S. Pat. No. 5,725,886. The flavoring agents can vary, and include menthol, vanillin, citric acid, malic acid, cocoa, licorice, and the like, as well as combinations thereof. See, Leffingwell et al., Tobacco Flavoring for Smoking Products (1972).

Optional flavorant material includes at least one or more ingredients, preferably in liquid form such as saturated, unsaturated, fatty and amino acids; alcohols, including primary and secondary alcohols; esters; activated carbonyl compounds, including ketones and aldehydes; lactones; cyclic organic materials including benzene derivatives, alicyclics, hetero-cyclics such as furans, thiazoles, thiazolidines, pyridines, pyrazines and the like; sulfur-containing materials including thiols, sulfides, disulfides and the like; proteins; lipids; carbohydrates; so-called flavor potentiators; natural flavoring materials such as cocoa, vanilla, and caramel; essential oils and extracts such as menthol, carvone and the like; artificial flavoring materials such as vanillin; Burley, Oriental and Virginia tobacco-like taste nuances and the like; and aromatic materials such as fragrant alcohols, fragrant aldehydes, ketones, nitriles, ethers, lactones, hydrocarbons, synthetic essential oils, and natural essential oils including Burley, Oriental and Virginia tobacco-like aroma nuances and the like. The quantity of flavorant contained in the tobacco beads can be chosen to provide a desired rate of delivery of volatile flavor compounds to mainstream smoke passing through the filter during smoking of the entire cigarette. The flavorant is preferably released into the mainstream smoke without heating of the tobacco beads, i.e., the flavorant is released into the smoke at or about room temperature.

Tobacco products generally contain one or more flavors as additives for enhancement of the smoking flavor. Flavors which are added to tobacco products are normally categorized into two groups; a primary flavor group for casing sources, and a secondary flavor group for top flavors. These flavors are often added to shredded tobacco by means of a direct spraying technique, which takes place during the process of manufacturing cigars or cigarettes. In accordance with one embodiment, a traditional cigarette, such as a lit-end cigarette, or non-traditional cigarette, such as a cigarette used in an electrical smoking system (see U.S. Pat. No. 6,026,820, incorporated herein by reference in its entirety) can include a standard or common tobacco mixture in the tobacco rod and appropriately flavored tobacco beads in a filter of the cigarette can be used to achieve desired taste attributes of the cigarette. In another embodiment, the tobacco beads are incorporated in a filter of a smoking article which uses heat from a combustible fuel element to volatilize tobacco (see, for example, U.S. Pat. No. 4,966,171, incorporated herein by reference in its entirety).

In a further embodiment, the tobacco beads may be coated with a film suitable for minimizing migration of volatile flavor compounds during storage of cigarettes containing the tobacco beads in the filter thereof. Such coatings may include natural polysaccharides or derivatives thereof.

The wet mass is extruded through suitably sized pierced screens and spheronized using a rotating disk having a grooved surface. The spheres are then dried in a fluidized bed or conventional convection oven or vacuum oven to a moisture level of about 0.5% to about 25%. The tobacco beads are produced in the form of "spheroids" having diameters in the range of about 0.1 to about 2.5 mm, more preferably from about 0.2 to about 1.2 mm and most preferably from about 0.3 to about 0.7 mm (and any 0.1 value in between these ranges)). The spheroids can be round or oval in structure.

One advantage of the tobacco beads when used in a filter downstream of a sorbent is that addition of special flavoring additives to the tobacco rod can be omitted. Instead, the desired flavoring can be provided in the tobacco beads. While the tobacco beads are effective in modifying the taste of mainstream smoke passing through cigarette filters having upstream sorbents such as activated carbon, the tobacco beads are also used to flavor mainstream smoke in cigarettes which do not include sorbent material in the filter. This allows a standard tobacco mixture to be used in the tobacco rod of a standard lit-end cigarette and the desired taste attributes of different cigarette products (e.g., regular, mild, full flavor, etc.) to be provided by the tobacco beads, which contain flavorant effective to achieve the desired taste of the mainstream smoke. Similarly, the tobacco beads can be used in filters of non-traditional cigarettes, such as those used with electrically heated cigarette smoking systems, wherein the cigarettes include standard tobacco plug and/or tobacco mat constructions and desired flavor attributes can be achieved by loading the cigarette filter with the tobacco beads that contribute the desired taste in the mainstream smoke.

Again, not wishing to be bound by theory, to the extent that mainstream smoke passing through the sorbent may produce heat (perhaps a heat from adsorption), the tobacco beads can be located adjacent the sorbent such that heat produced at the sorbent location may be used to supplement (promote) flavor release from the tobacco beads. Additionally, it is envisioned that a catalyst or other agent may be added to the cigarette filter at an upstream location (with or without the sorbent) so as to create an exothermic event as the mainstream smoke passes through the upstream location, whereby flavor release from the tobacco beads is enhanced.

The examples provided below are exemplary and are not meant to limit any aspects of the embodiments disclosed herein.

Example 1

2 parts of a blend of Bright and Burley tobacco dust obtained from the lamina (120 mesh) and 1 part of tap water were mixed to form a wet mass. The wet mass was extruded using a single-screw extruder (LCI Multi-Granulator MG-55) through a dome shaped, 0.6-mm opening die at an extrusion speed of 30 RPM. The resulting extrudates were spheronized using an LCI QJ-230T Marumerizer at a rotation speed of 1200 RPM for 10 minutes. Wet spheroids with uniform size distribution were obtained. The wet spheroids were subsequently dried in a vacuum oven at sub atmosphere conditions under flowing air at a temperature of 55° C. for 150 minutes. The resulting tobacco beads contained about 25% by weight of water (moisture). 200 mg of formed tobacco beads can be incorporated into a cigarette filter depicted in FIG. 6. During smoking, an enhanced tobacco aroma in the mainstream cigarette smoke can be achieved.

Example 2

2 parts of a blend of Bright and Burley tobacco dust obtained from the lamina (120 mesh) and 1 part of tap water were mixed to form a wet mass. The wet mass was extruded using a single-screw extruder (LCI Multi-Granulator MG-55) through a dome shaped, 0.6-mm opening die at an extrusion speed of 30 RPM. The resulting extrudates were spheronized using an LCI QJ-230T Marumerizer at a rotation speed of 1200 RPM for 10 minutes. Wet spheroids with uniform size distribution were obtained. The wet spheroids were subsequently dried in vacuum at a temperature of 55° C. for 240 minutes. The resulting tobacco beads contained about 13% by weight of water (moisture). 200 mg of formed tobacco beads can be incorporated into a cigarette filter depicted in FIG. 6. During smoking, an enhanced tobacco aroma in the mainstream cigarette smoke can be achieved.

Example 3

50 parts of AVICEL PH-200 (average particle size of 180 microns), 50 parts of Burley dust (120 mesh) and 120 parts of deionized water were mixed to form a wet mass. The wet mass was extruded using a single-screw extruder (LCI Multi-Granulator MG-55) through a dome shaped, 0.6-mm opening die at an extrusion speed of 30 RPM. The resulting extrudates were spheronized using an LCI QJ-230T Marumerizer at a rotation speed of 1200 RPM for 10 minutes. Wet spheroids with uniform size distribution were obtained. The wet spheroids were subsequently dried in a fluidized bed dryer (Mini-Glatt Fluid Bed Processor) with an inflow air temperature of 65° C. for 30 minutes. The resulting tobacco beads with binder additive contained less than 5% of water (moisture) and had good hardness and attrition resistance. 200 mg of formed tobacco beads can be incorporated into a cigarette filter depicted in FIG. 6, resulting in an enhanced tobacco aroma in the mainstream cigarette smoke. When the tobacco beads include after-cut (or top) flavors, the cigarette can produce a smoke which overcomes the objectionable taste notes usually associated with carbon bearing ("charcoal") cigarettes.

Example 4

50 parts of AVICEL PH-105 (average particle size of 20 microns), 50 parts of Burley dust (120 mesh) and 120 parts of deionized water were mixed to form a wet mass. The wet mass was extruded using a single-screw extruder (LCI Multi-Granulator MG-55) through a dome shaped, 0.6-mm opening die at an extrusion speed of 30 RPM. The resulting extrudates were spheronized using an LCI QJ-230T Marumerizer at a rotation speed of 1200 RPM for 10 minutes. The wet spheroids were subsequently dried in a fluidized bed dryer (Mini-Glatt Fluid Bed Processor) with an inflow air temperature of 65° C. for 30 minutes. The resulting tobacco beads with binder additive contained less than 5% of water (moisture); however, the hardness, attrition resistance and uniformity of the size distribution were not as good as the tobacco beads produced in Example 3. This may be due to the significant difference in the particle size between AVICEL PH-105 and Burley dust.

Example 5

50 parts of AVICEL PH-101, 50 parts of production tobacco dust (which contains a blend of Burley, Bright, Oriental tobacco dust as well as casing, after-cut flavors and humectants) and 120 parts of deionized water were mixed to form a wet mass. The wet mass was extruded using a single-screw extruder (LCI Multi-Granulator MG-55) through a dome shaped, 0.6-mm opening die at an extrusion speed of 30 RPM. The resulting extrudates were spheronized using an LCI QJ-230T Marumerizer at a rotation speed of 1200 RPM for 10 minutes. Large irregularly shaped tobacco agglomerates were formed.

Example 6

50 parts of AVICEL PH-101, 50 parts of production tobacco dust (which contains a mixture of Burley, Bright, Oriental tobacco dust as well as casing, after cut flavors and humectants) and 80 parts of deionized water were mixed to form a wet mass. The wet mass was extruded using a single-screw extruder (LCI Multi-Granulator MG-55) through a dome shaped, 0.6-mm opening die at an extrusion speed of 30 RPM. The resulting extrudates were spheronized using an LCI QJ-230T Marumerizer at a rotation speed of 1200 RPM for 10 minutes. Wet spheroids with uniform size distribution were obtained. The wet spheroids were subsequently dried in a fluidized bed dryer (Mini-Glatt Fluid Bed Processor) with an inflow air temperature of 65° C. for 30 minutes. The resulting tobacco beads with binder additive contained less than 5% of water (moisture) and had good hardness and attrition resistance. 200 mg of made tobacco beads can be incorporated into a cigarette filter depicted in FIG. 6, resulting in an enhanced tobacco aroma in the mainstream cigarette smoke.

Example 7

A liquid mixture containing 67% of glycerin and 33% of deionized water was prepared. 130 parts of the resulting glycerin/water mixture were mixed with 50 parts of AVICEL® PH-101, 50 parts of Burley dust (120 mesh) to form a wet mass. The wet mass was extruded using a single-screw extruder (LCI Multi-Granulator MG-55) through a dome shaped, 0.6-mm opening die at an extrusion speed of 30 RPM. The resulting extrudates were spheronized using an LCI QJ-230T Marumerizer at a rotation speed of 900 RPM for 10 minutes. Wet spheroids with uniform size distribution were obtained. The wet spheroids were subsequently dried in a convection oven at a temperature of 100° C. under a vacuum pressure of −3 inch Hg for 3 hours to remove water. The resulting tobacco beads with binder additive contained about 44% of glycerin and were free-flowing. The tobacco beads can be incorporated into the tobacco rod depicted in FIG. 7, for example.

For tobacco beads containing dry binder additive, it should be noted that the weight percent of dry binder and weight percent of tobacco particles appear to have conflicting effects: an increase in tobacco content increases the impact on the taste of the smoke but decreases the mechanical properties (i.e., hardness, attrition resistance) of the tobacco beads. On the other hand, an increase in the dry binder (e.g., MCC) appears to decrease the impact on the taste but increases the mechanical strength. The mechanical strength and uniformity in size distribution are also affected by the liquid content in the wet mass, size of the opening on the extrusion die, and processing parameters such as extrusion speed, rotation speed, and duration of spheronization. For a given blend of tobacco particles, the optimal formulation and processing conditions are empirically determined.

The preferred embodiments are merely illustrative and should not be considered restrictive in any way. The scope of the invention is given by the appended claims, rather than the preceding description, and all variations and equivalents which fall within the range of the claims are intended to be embraced therein. For example, sorbents other than activated carbon might be employed, such as mesoporous molecular sieves, silica gel, or other material. Moreover, the present invention may be practiced with cigarettes of various circumferences, narrow cigarettes as well as wide. Also, while the present invention is preferably practiced with unflavored tobacco rods, flavored tobacco filler is also contemplated. Furthermore, in all embodiments the sorbent itself may be either flavor-bearing or without flavor; and the sorbent may be granular, beaded, flaked, fibrous and/or other suitable forms. Furthermore, the ventilation holes of the preferred embodiments are preferably at a location downstream of the sorbent bearing filter segment, but other locations are workable, even at a location along the sorbent segment. It is also contemplated that the sorbent and the tobacco beads be mixed together.

All patents cited above are incorporated herein in their entirety for all purposes.

What is claimed is:

1. A smoking article comprising:

a tobacco rod; and a filter, the filter comprising an activated carbon sorbent at an upstream location along the filter and at least one tobacco bead at a downstream location along the filter, each tobacco bead consisting essentially of:

(a) tobacco lamina particles;

(b) water;

(c) one or more flavorants; and (d) microcrystalline cellulose, wherein the tobacco bead has a moisture content of about 8% to about 25% of a total weight of the tobacco bead, wherein the tobacco bead is in a condition of having been extruded, rounded and vacuum dried to said moisture content, wherein the one or more flavorants comprises menthol, wherein the one or more flavorants are trapped within the tobacco beads so as to minimize migration or evaporation of the one or more flavorants during storage, and wherein the one or more flavorants are released in the absence of cigarette coal heat to enhance tobacco character and reduce carbon off-taste.

2. The smoking article of claim 1, wherein the tobacco bead is in the form of a spheroid having a diameter of about 0.3 mm to about 0.7 mm.

3. The smoking article of claim 1, wherein the tobacco bead includes from about 0.1% to about 50% by weight of said one or more flavorants.

4. The smoking article of claim 1, wherein the tobacco bead includes a moisture content of about 10% to about 20%.

5. The smoking article of claim 1, wherein the tobacco bead further comprises a diluent, an aerosol forming agent, or a combination thereof.

6. The smoking article of claim 1, wherein: (a) the tobacco particles have an average particle diameter of less than about 0.5 mm; (b) the tobacco bead is in the form of a spheroid, wherein the spheroid is substantially round or substantially oval in shape; (c) the tobacco bead is in the form of a spheroid, wherein the spheroid has a diameter of about 0.1 to about 2.5 mm; (d) the tobacco bead is in the form of a spheroid, wherein the spheroid has a diameter of about 0.2 to about 1.2 mm; (e) the tobacco bead is in the form of a spheroid, wherein the spheroid has a diameter of about 0.3 to about 0.7 mm; (f) the tobacco particles have a maximum size of about 0.5 mm; (g) the tobacco particles comprise ground tobacco selected from the group consisting of Burley, Bright, and Oriental; (h) the tobacco bead comprises one or more flavorants, wherein the one or more flavorants is selected from the group consisting of liquid, solid and/or gel flavorant; (i) the tobacco bead comprises one or more flavorants, wherein the one or more flavorants is present in the tobacco bead in an amount of up to 50% by weight; and/or (j) the moisture content is about 8% to about 10%, about 10% to about 15%, about 15% to about 20%, or about 20% to about 25% of the total weight of the tobacco bead.

7. The smoking article of claim 1, wherein the tobacco bead is in a condition of having been vacuum dried.

8. The smoking article of claim 7, wherein the tobacco bead is in a condition of having been vacuum dried at a temperature of 55° C. for 150 minutes and has a moisture content of about 25%.

9. The smoking article of claim 7, wherein the tobacco bead is in a condition of having been vacuum dried at a temperature of 55° C. for 240 minutes and has a moisture content of about 13%.

10. The smoking article of claim 1, wherein the smoking article is used in an electrical smoking system.

* * * * *